US011375592B2

(12) United States Patent
Huang et al.

(10) Patent No.: US 11,375,592 B2
(45) Date of Patent: Jun. 28, 2022

(54) LIGHTING APPARATUS

(71) Applicant: XIAMEN ECO LIGHTING CO. LTD., Xiamen (CN)

(72) Inventors: Libin Huang, Xiamen (CN); Zhizhong Wu, Xiamen (CN); Hongbin Lin, Xiamen (CN); Wenchung Huang, Xiamen (CN); Hongkui Jiang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/860,247

(22) Filed: Apr. 28, 2020

(65) Prior Publication Data

US 2021/0029797 A1 Jan. 28, 2021

(30) Foreign Application Priority Data

Jul. 26, 2019 (CN) ..... 201921201496.3

(51) Int. Cl.

| | |
|---|---|
| ***H05B 45/30*** | (2020.01) |
| ***H05B 45/20*** | (2020.01) |
| ***H05B 45/10*** | (2020.01) |
| ***F21V 9/08*** | (2018.01) |
| ***F21V 23/04*** | (2006.01) |
| ***F21Y 115/10*** | (2016.01) |

(52) U.S. Cl.

CPC ..... *H05B 45/30* (2020.01); *F21V 9/08* (2013.01); *F21V 23/0407* (2013.01); *H05B 45/10* (2020.01); *H05B 45/20* (2020.01); *F21Y 2115/10* (2016.08)

(58) Field of Classification Search

CPC ..... H05B 45/30; H05B 45/20; H05B 45/10; H05B 45/44; F21V 9/08; F21V 23/0407; F21Y 2115/10

See application file for complete search history.

(56) References Cited

U.S. PATENT DOCUMENTS

| | | | | |
|---|---|---|---|---|
| 2013/0127350 | A1* | 5/2013 | Frias, Sr. | H05B 45/44 315/185 R |
| 2013/0313987 | A1* | 11/2013 | Chu | H05B 45/44 315/297 |
| 2016/0066381 | A1* | 3/2016 | Despesse | H05B 45/397 315/191 |
| 2020/0296813 | A1* | 9/2020 | Saes | H05B 45/20 |

* cited by examiner

*Primary Examiner* — Raymond R Chai
(74) *Attorney, Agent, or Firm* — Chun-Ming Shih; Lanway IPR Services

(57) ABSTRACT

A lighting apparatus includes a driver, a first branch, a second branch, a first switch, a second switch, multiple middle switches, and a switch control unit. The first branch includes multiple first LED modules. The multiple first LED modules are divided into multiple first segments. There are first nodes between adjacent first segments. The second branch includes multiple second LED modules. The multiple second LED modules are divided into multiple second segments. There are second nodes between adjacent second segments. The switch control unit is used for controlling selections of the first switch, the second switch and the multiple middle switches for determining a conductive path of a selected set of LED modules selected from the multiple first segments and the multiple second segments for mixing a required optical parameter.

18 Claims, 10 Drawing Sheets

Flg. 2

Flg. 10

LIGHTING APPARATUS

FIELD

The present application is related to a lighting apparatus and more particularly related to a lighting apparatus with adjustable parameters.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

In some applications, it is important to project a light on an object or an area to emphasize the object or the area.

When technologies are developing, people expect more functions and flexibility on using lighting apparatuses, for all types of lighting devices, e.g. light bulbs, light tubes, downlight devices.

It is challenging and beneficial to design a flexible lighting apparatus that is easy to be configured, adjusted while keeping low cost for manufacturing.

SUMMARY

In some embodiments, a lighting apparatus includes a driver, a first branch, a second branch, a first switch, a second switch, multiple middle switches, and a switch control unit.

The driver converts an indoor power source to a driving current. For example, an indoor power source of 110V/220V alternating current is converted by the driver to a direct current driving current for driving LED modules to emit light.

The first branch includes multiple first LED modules. The multiple first LED modules are divided into multiple first segments. There are first nodes between adjacent first segments. The switch may be turned on or turned off to electrically connect or disconnect corresponding adjacent first segments above and below corresponding first node. Each first segment may include one or multiple first LED modules. Each first LED module emits a light with a first optical parameter when receiving a proper driving current.

The second branch includes multiple second LED modules. The multiple second LED modules are divided into multiple second segments. There are second nodes between adjacent second segments. The switch may be turned on or turned off to electrically connect or disconnect corresponding adjacent second segments above and below corresponding second node. Each second segment may include one or multiple second LED modules. Each second LED module emits a light with a second optical parameter when receiving a proper driving current. The first optical parameter may correspond to a first color temperature and the second optical parameter may correspond to a second color temperature.

The first switch is selectively connecting the driving current into the first branch. The second switch is selectively connecting the driving current into the second branch. The multiple middle switches are selectively connecting the first nodes and second nodes. Specifically, all LED modules in the lighting apparatus are divided into the first segments on the first branch and the second segments on the second branch. By selecting the first switch, the second switch and the middle switches, the conductive path is selected and the LED modules on the selected conductive path is supplied with the driving current. The LED modules not on the selected conductive path is turned off. When the LED modules have different types, selections of different types of LED module correspond to different optical parameters.

The switch control unit is used for controlling selections of the first switch, the second switch and the multiple middle switches for determining a conductive path of a selected set of LED modules selected from the multiple first segments and the multiple second segments for mixing a required optical parameter.

In some embodiments, the first LED modules refer to a first type of LED module emitting a light of a first color temperature. The second LED module refer to a second type of LED module emitting another light of a second color temperature. The parameter color temperature may be replaced as color or any other optical parameter.

In some embodiments, the first LED modules emit a first light with a first color temperature, and the second LED modules emit a second light with a second color temperature.

In some embodiments, the first segments have multiple types of mixed optical parameters.

Specifically, not every first segment has the same kinds of LED modules. More than one types of LED modules may be placed in the same first segment, making each first segment having different features. In some other embodiments, the first segments may have multiple types of optical parameters. In some other embodiments, the first segments may all have the same type of optical parameter.

Similarly, the second segment may have the same configuration as the first segments as mentioned above.

Specifically, there are multiple first segments. These first segments may have both a first type of LED module and a second type of LED module. The number ratio of the first type of LED module and the second type of LED module may not be the same in every first segment. In other words, there may be multiple types of first segments containing different number ratio of the first type of LED module and the second type of LED module. The first type of LED module and the second type of LED module indicates that different types of LED module may have different optical parameters like color temperatures.

In some embodiments, at least two first segments have different number ratio of a first type of LED module and a second type of LED module.

In some embodiments, the driver includes a linear driver circuit for generating a constant current as the driving current.

In some embodiments, the switch control unit is configured with a manual switch operated by a user.

In some embodiments, the manual switch provides multiple options, each option corresponding to one conductive path of corresponding selected set of LED modules selected from the multiple first segments and the multiple second segments for mixing a required optical parameter In some embodiments, the switch control unit and the driver are integrated as an integrated chip, the first segments and the second segments are connected to the integrated chip for performing the first switch, the second switch and the multiple middle switches.

In some embodiments, the first LED modules and the second LED modules are high voltage LED devices.

In some embodiments, the switch control unit is a direct switch toggling circuits, not made as a micro control unit.

In some embodiments, a manual switch has multiple options to be selected by a user, each option is translated to turn on a switch set from the first switch, the second switch and the multiple middle switches.

In some embodiments, a manual switch has multiple options to be selected by a user, each option corresponds to turn on one corresponding middle switch.

In some embodiments, the lighting apparatus may also include a tubular housing for disposing the first branch and the second branch, wherein a manual switch has multiple options to be selected by a user, the manual switch is placed on an end cap of tubular housing.

In some embodiments, the lighting apparatus may also include a bulb shell for disposing the first branch and the second branch, wherein a manual switch has multiple options to be selected by a user, the manual switch is placed on a bulb head connected to the bulb shell.

In some embodiments, the lighting apparatus may also include a downlight housing for disposing the first branch and the second branch, wherein a manual switch has multiple options to be selected by a user, the manual switch is placed on a driver box connected to the downlight housing.

In some embodiments, the lighting apparatus may also include a downlight housing with a light source plate for disposing the first branch and the second branch, wherein a manual switch has multiple options to be selected by a user, the manual switch is placed on a surface rim of the downlight housing, the driver and the switch control unit are disposed on the light source plate.

In some embodiments, the lighting apparatus may also include a wireless module for receiving an external command from an external device, the wireless module is connected to the switch control unit, the switch control unit determines using the external command or a manual switch based on a predetermined priority list.

In some embodiments, the driver is connected to a dimmer switch, the dimmer switch provides a setting for the driver to adjust the driving current.

In some embodiments, the setting of the dimmer switch is divided into a set of dimmer options, each dimmer option corresponds to control the switch unit to select a selected from the first segments and the second segments.

In some embodiments, the first segments and the second segments have multiple light intensity levels, and an output light intensity is determined by selecting a selected set from the first segments and the second segments.

DETAILED DESCRIPTION

Figure 1:
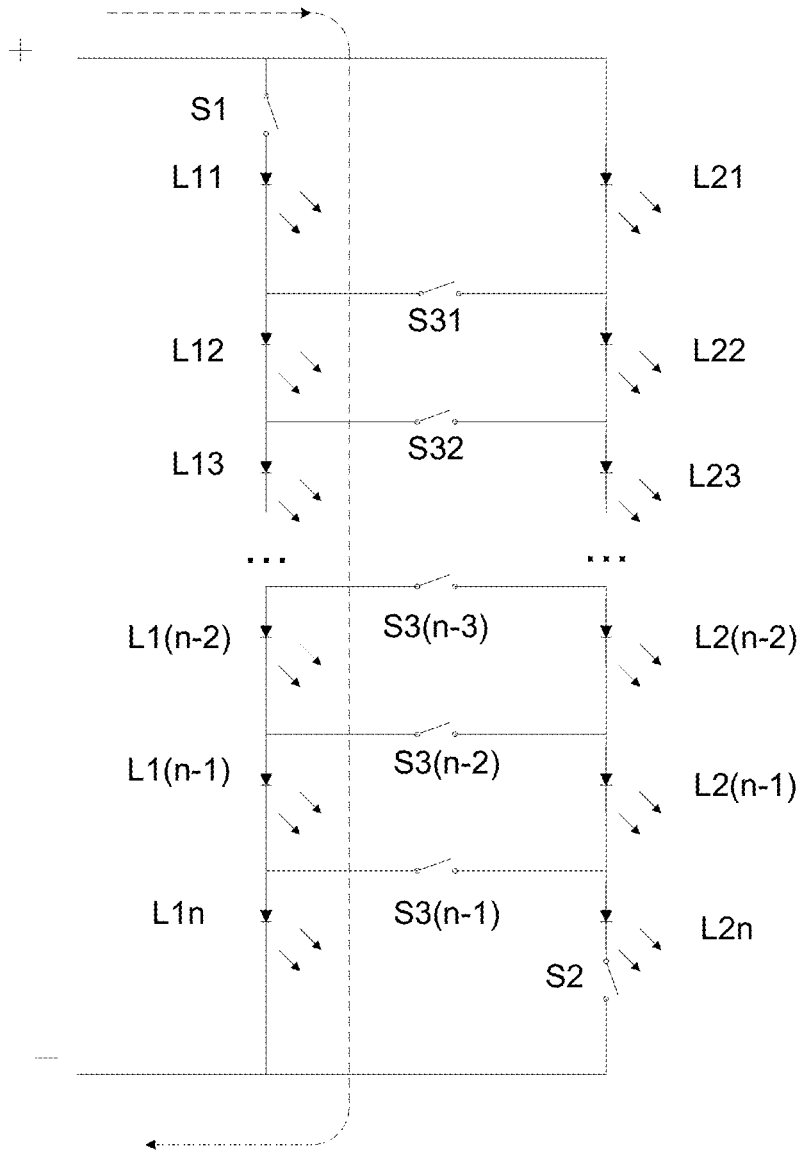
FIG. 1 illustrates a conductive path example.

Please refer to FIG. 1. FIG. 1 is an embodiment of a color temperature LED circuit. The color temperature adjusting LED circuit includes a first branch, a second branch and at least one third switch. The first branch includes a first switch connected in series and multiple first set of LED modules. The second branch connected in parallel with the first branch including multiple second set of LED modules connected in series and a second switch. The first set of LED modules and the second set of LED modules have different color temperature. The third switch has a first end connected between the two adjacent first set of LED modules in the first branch. A second end of the third switch is connected between the two adjacent second set of LED modules in the second branch.

In an embodiment of the circuit diagram, the branch on the left of the diagram is noted as the first branch and the branch on the right of the diagram is noted as the second branch. The notification of first branch and the second branch is only for the convenience of description but may make no limitations to the embodiments.

In an embodiment, two branches are provided. The color temperature of the first set of LED modules in the first branch is noted as a first color temperature. The color temperature of the second set of LED modules is noted as a second color temperature. When the first set of LED modules in the first branch is all being turned on and the second set of LED modules in the second branch is all being turned off, the color temperature of the color temperature LED circuit is the first color temperature. When the first set of LED modules in the first branch is all being turned off and the second set of LED modules in the second branch is all being turned on, the color temperature of the color temperature LED circuit is the second color temperature. The first color temperature is different from the second color temperature.

In an embodiment, the first branch and the second branch is connected in parallel. A first switch is set in the first branch for controlling the first set of LED modules of the first branch to turn on and turn off and a second switch is set in the second branch for controlling the second set of LED modules of the second branch to turn on and turn off for making the first color temperature and the second color temperature to demonstrate separately. The first color temperature is different from the second color temperature. Thus, a high color temperature and a low color temperature may demonstrate separately. In practical applications, the first color temperature may be higher or lower than the second color temperature and may have no limitations being provide here. For example, the first color temperature may be 3700K and the second color temperature may be 6000K for showing a 3000K effect and a 6000K effect respectively.

In order to demonstrate a middle color temperature which is a color temperature value between the first color temperature and the second color temperature, the first set LED modules in the first branch may be all connected in series and the second set LED modules in the second branch may be all connected in series. A third switch cross connected between the first branch and the second branch. Through the setting of the third switch, the first set of LED modules in the first branch and the second set of the LED modules in the second branch is turned on at the same timing when the third switch is closed for a demonstration of a mixture of the high and low color temperature into the middle color temperature.

In practical applications, the first branch may include other electronic elements such as resistance or the a third LED . . . etc. Take multiple third LED as example, the multiple third LED may be connected in series with the first set of LED modules and/or constitute together as the first branch after being connected in parallel. For example, the color temperature of the third LED is a third color temperature such as 2000K. When the first switch is closed, the color temperature of the current circuit is a mixture of the first color temperature and the third color temperature which is a mixture of an at least 3000K and a 2000K) and of course there are other examples. From the description above, the first branch includes a first switch and a first set of LED modules connected in series and also other electronic elements. The second branch also includes other electronic elements such as the first branch.

In order to make a simplified concept between the first switch, the second switch and the third switch to ensure the color temperature is unrelated to the second color temperature when the first switch is in a turn-off mode and the second switch and the third switch is in a turn-on mode, the color temperature is unrelated to the first color temperature when the second switch is in a turn-off mode and the first switch and the third switch is in a turn-on mode or the middle color temperature is related to the first color temperature and the second color temperature when the third switch is in a turn-off mode and the first switch and the second switch is in a turn-on mode. First of all, the first switch and the second switch may be respectively fixed in the head and the end of their branch.

In an embodiment, the first switch may be set in an anode direction of the first one of the first set of LED modules connected in series and set the second switch in a cathode direction of the last second set of LED modules connected in series at the same time such as which is shown in FIG. 1. Thus, it may be understood as the first branch includes the first switch connected in series and the multiple first set of LED modules, the second branch includes the multiple second set of LED modules and the second switch.

Figure 2:
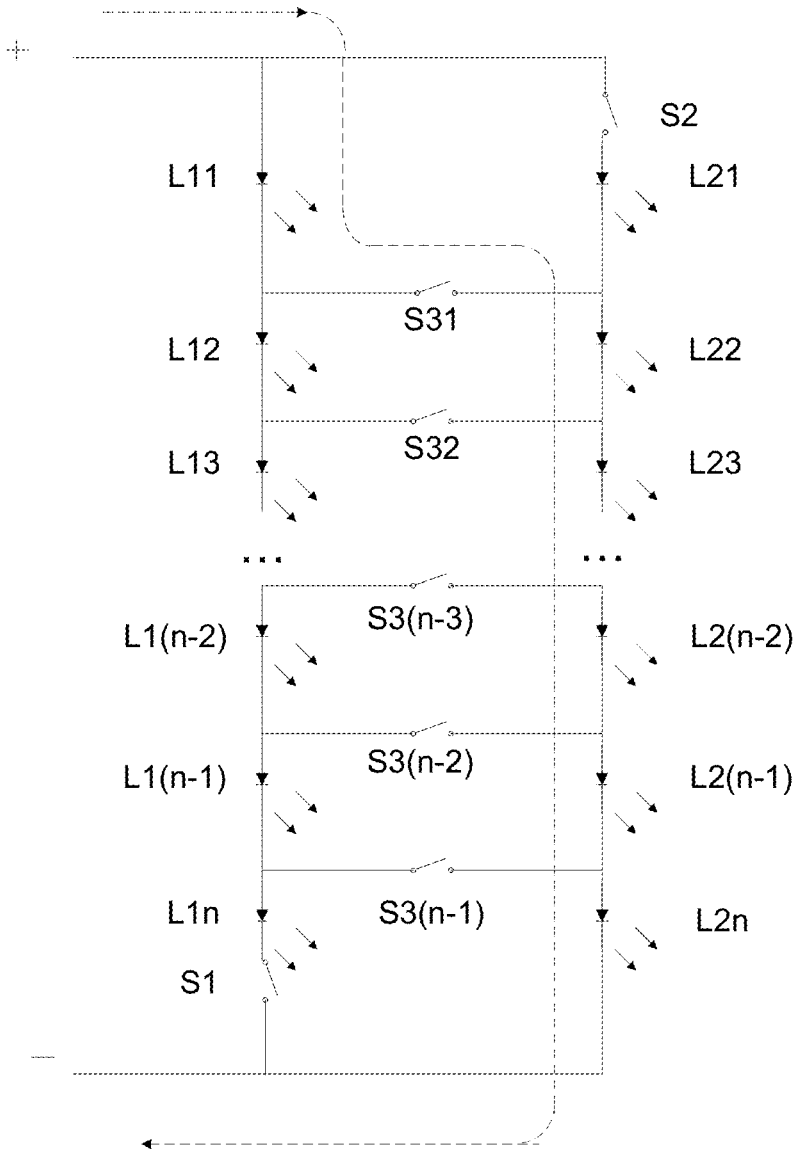
FIG. 2 illustrates another conductive path example.

Please refer to FIG. 2. In an embodiment, the first switch may be set to an cathode direction of the last first set of LED modules connected in series and set the second switch to the first one of an anode direction of the second set of LED modules connected in series at the same time such as which is shown in FIG. 2.

In order to make the third switch in a turn-off mode, the first switch and the second switch in a turn-on mode to have the middle color temperature related to the first color temperature and the second color temperature for an effect of the middle color temperature as the mixture of the high color temperature and the low color temperature. The first end of the third switch may have to be connected between the two adjacent first set of LED modules in the first branch. The second end of the third switch may be connected between the two adjacent second set of LED modules of the second branch. In practical applications, a fourth switch may be set. A first end of the fourth switch is fixed between the first switch and the two adjacent first set of LED modules, a second end of the fourth switch is fixed between the two adjacent second set of LED modules, the second end of the fourth switch is fixed between the second switch and the two adjacent second set of LED modules, and the first end of the fourth switch is fixed between the two adjacent first set of LED modules.

Figure 3:
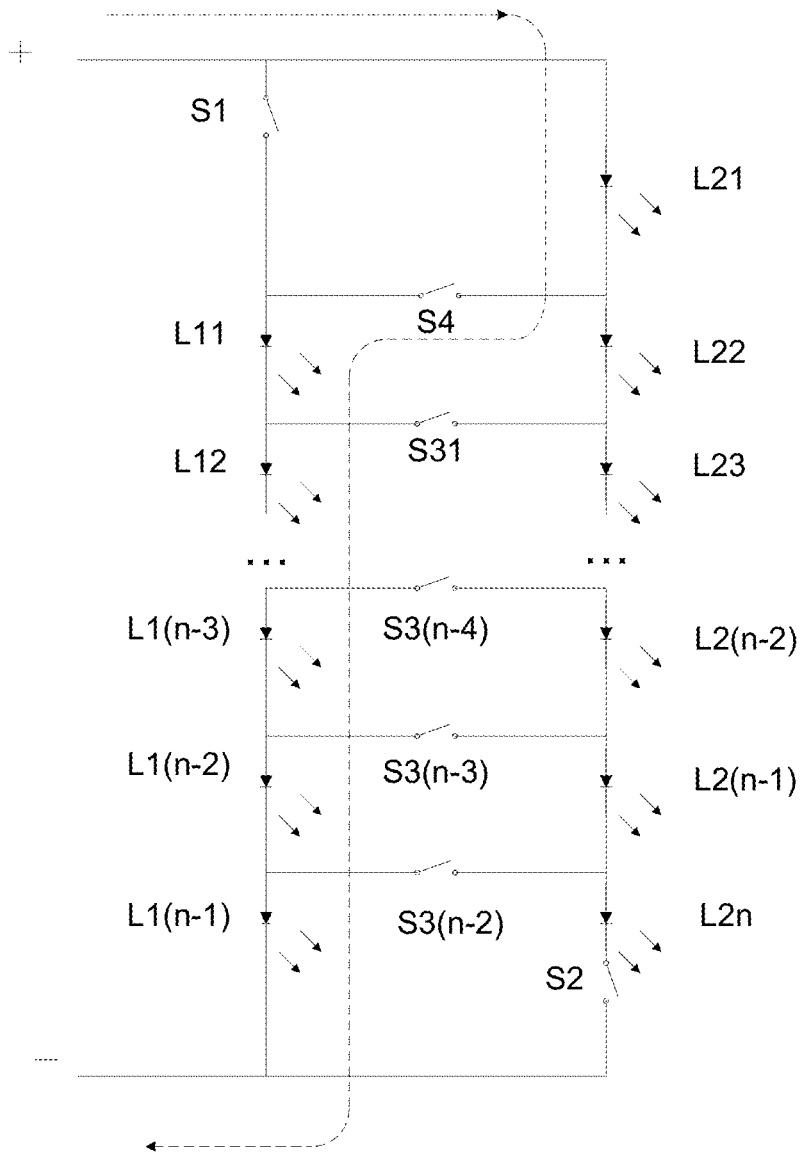
FIG. 3 illustrates another conductive path example.

Please refer to FIG. 3. In an embodiment, when the first end of the fourth switch S4 is fixed between the first switch and the two adjacent first set of LED modules, the second end of the fourth switch S4 is fixed between the two adjacent second set of LED modules. Meanwhile, the first switch, the second switch and the third switch are all in the turn-on mode and the fourth switch is in the turn-off mode, the passing of the current is shown as dashed lines in FIG. 3. The current passes the first second set of LED modules L21 and n−1 first set of LED modules. Meantime, the current shown in FIG. 3 has the color temperature effect as a mixture effect of the first color temperature of LED and n−1 second color temperature of LED.

Figure 4:
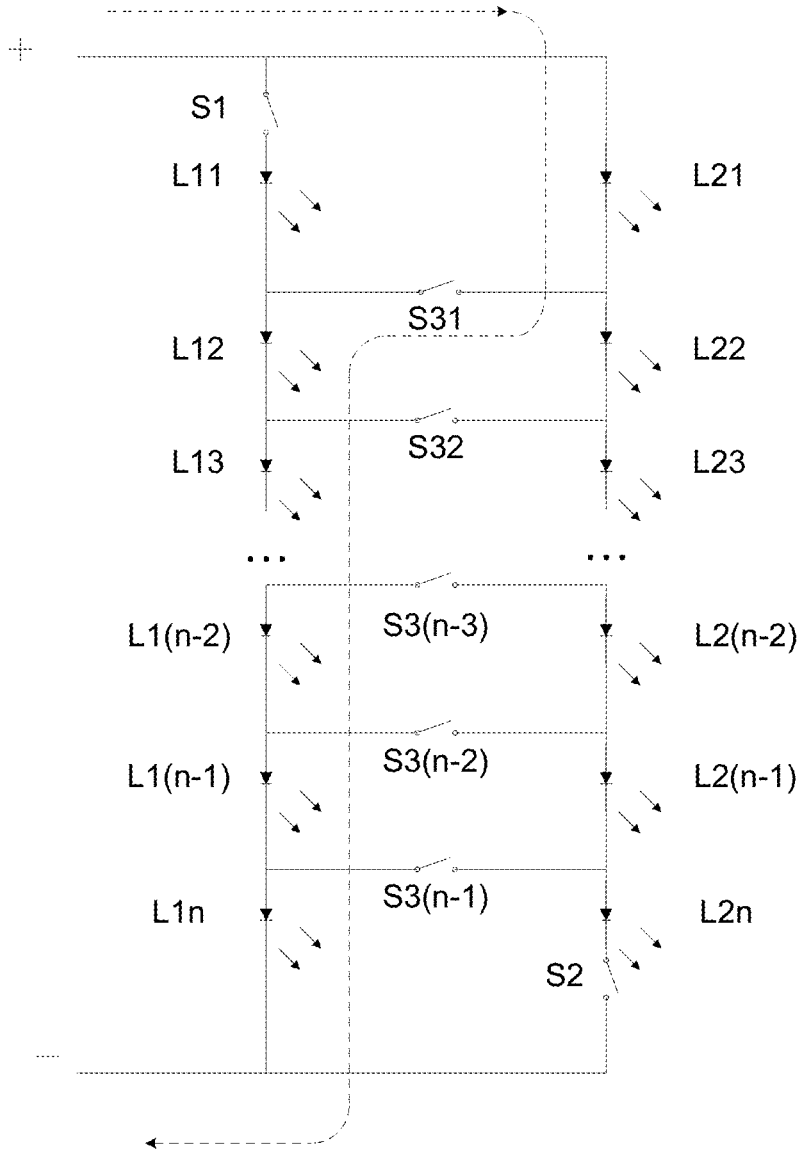
FIG. 4 illustrates another conductive path example.

Please refer to FIG. 4. In an embodiment, the color temperature LED circuit without the fourth switch is shown in FIG. 4. The first end of the third switch is connected between the two adjacent first set of LED modules in the first branch and the second end of the third switch is connected between the two adjacent second set of LED modules of the second branch. When the third switch S31 is closed and the first switch and the second switch is opened, the current of then is shown as dashed lines in FIG. 4. Meanwhile, the color temperature of the circuit is the mixture effect of one LED of the second color temperature and n−1 LED of the first color temperature. In practical applications, the amount of the third switch may be one or more.

Figure 5:
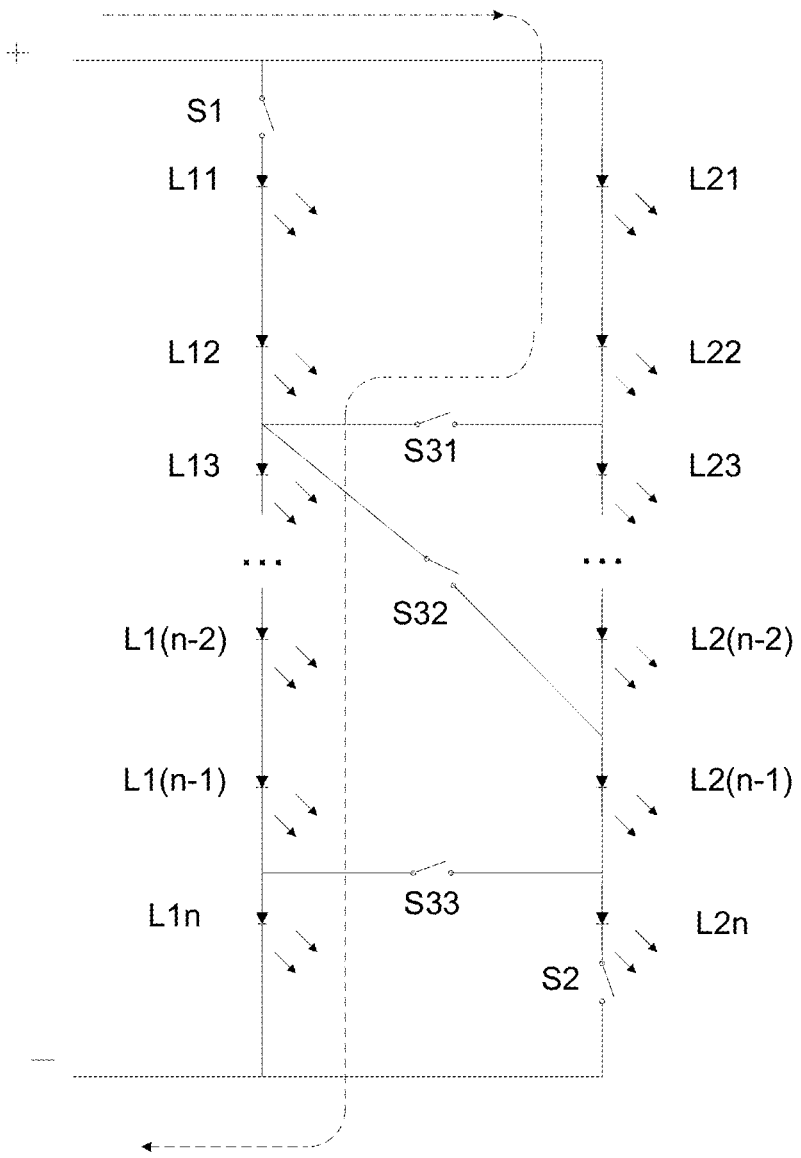
FIG. 5 illustrates another conductive path example.

Please refer to FIG. 5. FIG. 5 shows another embodiment of the color temperature LED circuit. The amount of the third switch is divided as S31, S32 and S33. The first end of S31 and S32 is common connected and the second end of S31 and S32 is disconnected.

When the third switch S31 is closed and the first switch, the second switch, the third switch S32 and S33 is opened, the current of then is shown in FIG. 5. The color temperature of the circuit is the mixture effect of two LED of the second color temperature and n−2 LED of the first color temperature. When the third switch S32 is closed and the first switch, the second switch, the third switch S31 and S33 is opened, the current of then is shown as dashed lines in FIG. 6. Meanwhile, the color temperature of the circuit is the mixture effect of n−2 LED of the second color temperature and n−2 LED of the first color temperature.

Figure 6:
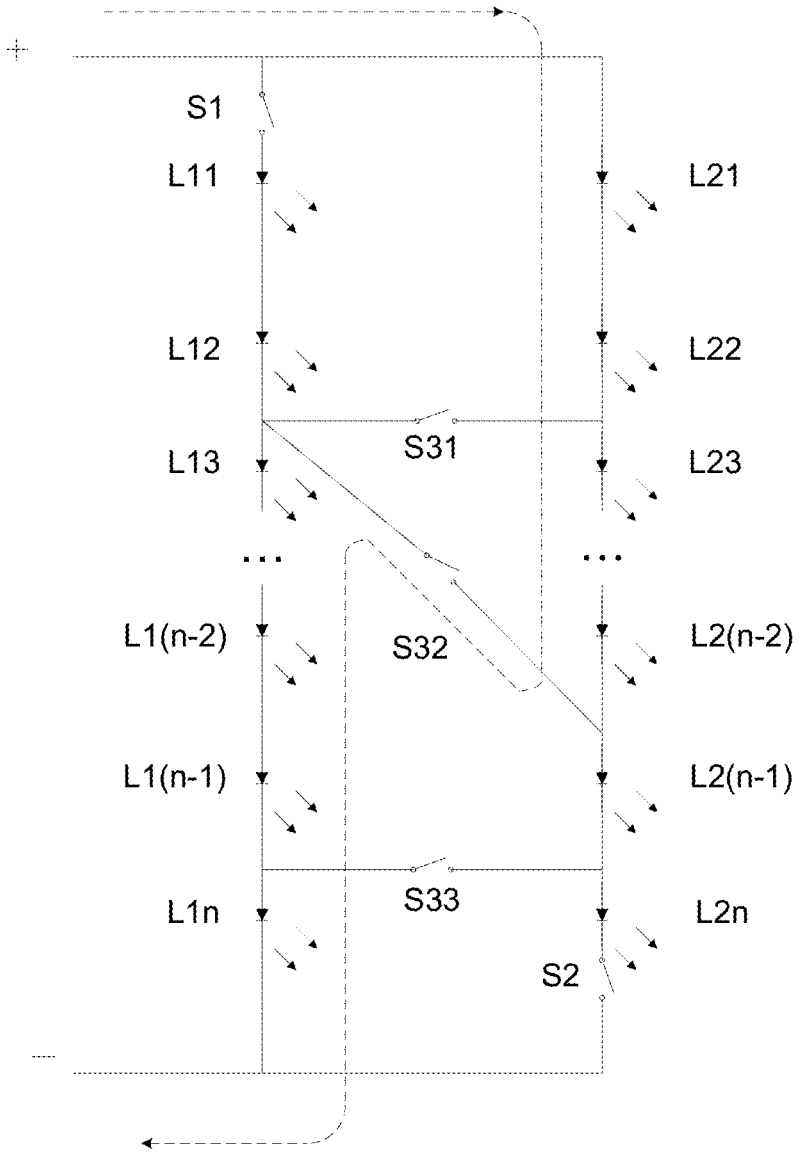
FIG. 6 illustrates another conductive path example.

However, the embodiment shown in FIG. 5 and FIG. 6 has a problem in the connection of the third switch. For example, the related turned-on amount of LED is not the same under the two color temperature which may cause a different brightness demonstration under the same driving electricity. In order to solve the problem, an embodiment provides a solution to solve the problem. When the amount of the third switch is more than one, between the first end of the third switch may be set disconnected and between the second end of the third switch is set disconnected. Please refer to FIG. 1, FIG. 2 and FIG. 4. Every first end of the third switch is placed in differently between the first set of LED modules and every second end of the third switch is set differently between the second set of LED modules.

Please refer to FIG. 1, FIG. 2 and FIG. 4. The connecting method of the third switch may solve the problem of the different brightness demonstration under different color temperature in FIG. 5 and FIG. 6. However, the amount of the first set of LED modules in the first branch and the amount of the second set of LED modules in the second branch being different may also have the problem of unequal brightness under different color temperature. Thus, in an embodiment, another color temperature LED circuit is provided for making the amount of the first set of LED modules in the first branch and the amount of the second set of LED modules in the second branch the same. For example, the amount of the first set of LED modules in the first branch and the amount of the second set of LED modules in the second branch are all n for limiting an equal brightness under the first color temperature and the second color temperature.

In an embodiment, a third switch may be set as closed and the first switch and the second switch is set as opened, and the total amount of the first set of LED modules and the second set of LED modules connected in the circuit is n for the brightness demonstration of the color temperature LED circuit being the same under every color temperature. Please refer to FIG. 1, FIG. 2 and FIG. 4. The first end of the third switch may be set between the no. i and no. i+1 first set of LED modules in the first branch and the second end of the third switch is set between the no. i and no. n+i second set of LED modules in the second branch.

Please refer to FIG. 4. When the first switch is the only one closed, the first branch is being conducted electricity and turned on the n amount of first set of LED modules in the first branch for a color temperature as the first color temperature sw1. When the second switch is the only one closed, the second branch is being conducted electricity and turned on the n amount of second set of LED modules in the second branch for a color temperature as the second color temperature sw2. When the first one of the third switches is the only one closed, the first one of the second set of LED modules in the second branch and the last n−1 one of the first set of the LED modules in the first branch is being turned on for the color temperature as ((n−1)sw1+sw2)/n. When the i one of the third switches is closed, the first i one of the second set of LED modules in the second branch and the last n−i one of the first set of the LED modules in the first branch is being turned on for the color temperature as ((n−I)sw1+i×sw2)/n. The turned-on LED amount is n under every color temperature.

Otherwise, the amount of the third switch may be set as a wanted color temperature level and the two ends of the third switch may be set between two LEDs. For example, the color temperature is set into three level for adjusting, the amount of n is 20 which may set one third switch, the first end of the third switch may be set between the tenth and the eleventh of the first set of LED modules and another end of the third switch may be set between no. 10 and no. 11 of the second set of LED modules. The color temperature may be set as five level for adjusting, the amount of n is 20 which may set three third switches, the first one of the first end of the third switch may be set between the fifth and the sixth of the first set of LED modules and the other end of the first third switch may be set between the fifth and the sixth of the second set of LED modules. The first end of the second of the third switch may be set between the tenth and the eleventh of the first set of LED modules. The other end of the second of the third switch may be set between the tenth and the eleventh of the second set of LED modules. The first end of the third of the third switch may be set between the fifteenth and the sixteenth of the first set of LED modules. The other end of the third of the third switch may be set between the fifteenth and the sixteenth second set of LED modules.

Figure 7:
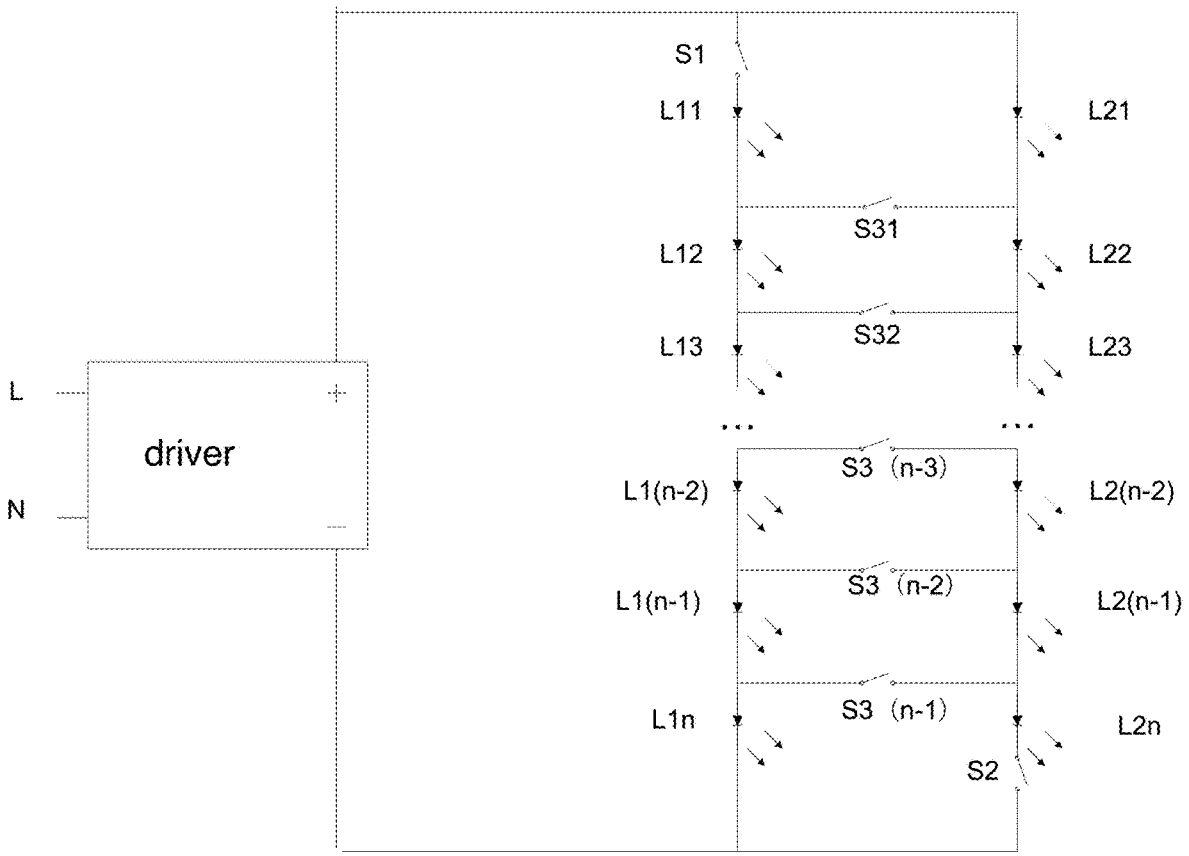
FIG. 7 illustrates a circuit diagram example.

Please refer to FIG. 7. In an embodiment, the color temperature LED circuit also includes a driving module connected to the first branch. The driving module and the first branch form a loop when the first switch in the first branch is closed. In practical applications, the driving module may be a detachable or integrated driving module.

Figure 8:
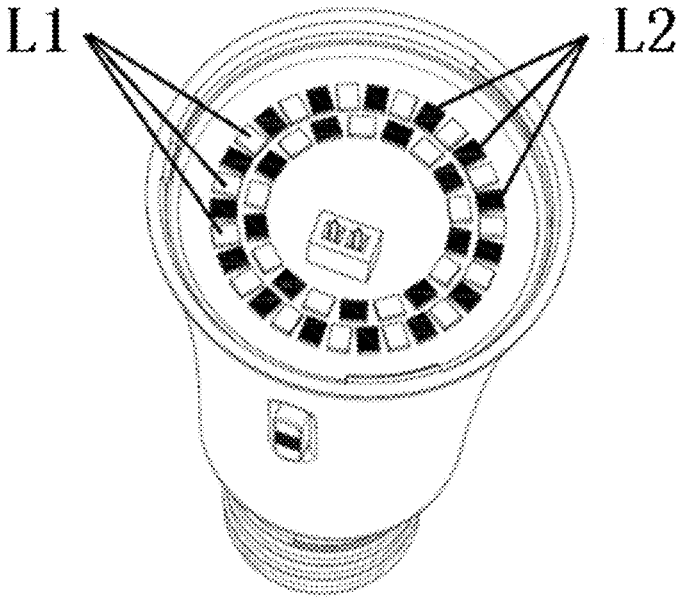
FIG. 8 illustrates a light bulb example.

Please refer to FIG. 8. FIG. 8 shows an embodiment of an arrangement of the LED. The first set of LED modules in the first branch is shown as L1. The external surrounded circle and the inner circle of the first set of LED modules is connected in series as a circle. The second set of the LED modules in the second branch is shown as L2. The external surrounded circle and the inner circle of the second set of LED modules is connected in series as a circle. The external surrounded circle of the first set of LED modules and the second set of the LED modules are arranged with a gap between each other. The inner circle of the first set of LED modules and the second set of the LED modules are arranged with a gap between each other. When the first switch is closed (the first color temperature), the first set of LED modules is turned on and is arranged equally without dark spots. When the second switch is the only one closed (the second color temperature), the second set of LED modules is turned on and is arranged equally without dark spots. When the I amount of the third switch is the only one closed (the middle color temperature), the first i amount of the second set of LED modules and the last n−i of the first set of LED modules in the first branch is turned on, and the first i of the second set of LED modules in the second branch and the last n−i second set of LED modules in the second branch is arranged equally without dark spots.

Figure 9:
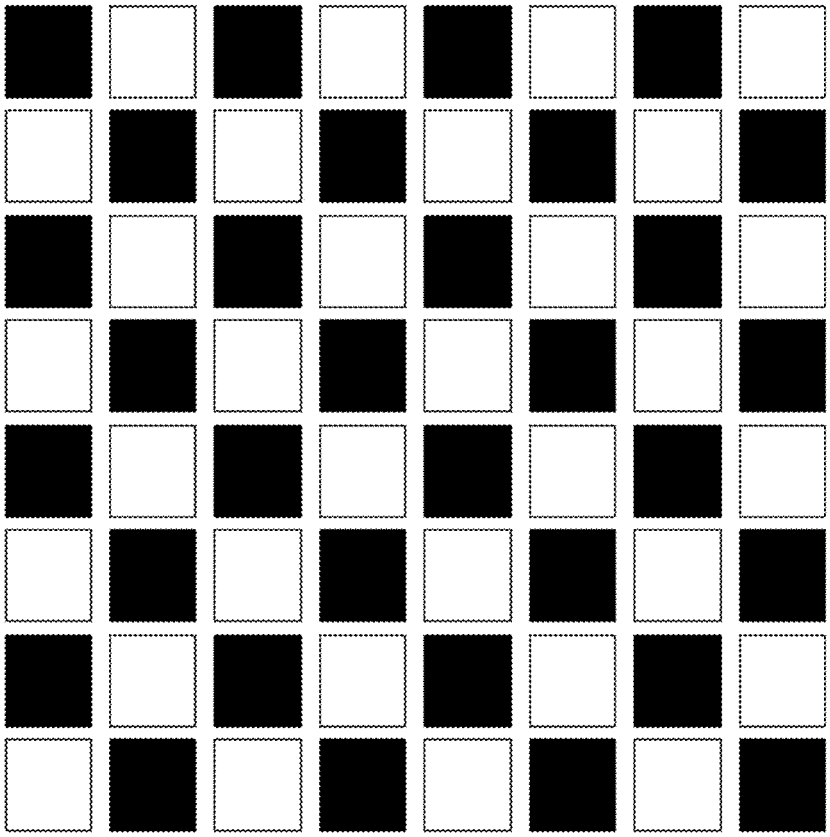
FIG. 9 illustrates arrangement of two types of LED module.

Please refer to FIG. 9. FIG. 9 shows an embodiment of an arrangement of the first set of LED modules and second set of LED modules. The white square is the first set of LED modules in first branch and the black square is the second set of LED modules in second set of LED modules. All of the first set of LED modules is connected in series on the transverse. Between the first set of LED modules on every transverse is connected in series. All of the second set of LED modules is also connected in series on the transverse. Between the second set of LED modules on every transverse is connected in series. The first set of LED modules or the second set of LED modules may be connected in series in vertical line and connect the vertical light string in series. The specific connecting method may not be limited. The arrangement shown in FIG. 8 may group the first set of LED modules and the second set of LED modules. Every group may have only One LED being turned on to avoid dark spots under each color temperature.

Figure 10:
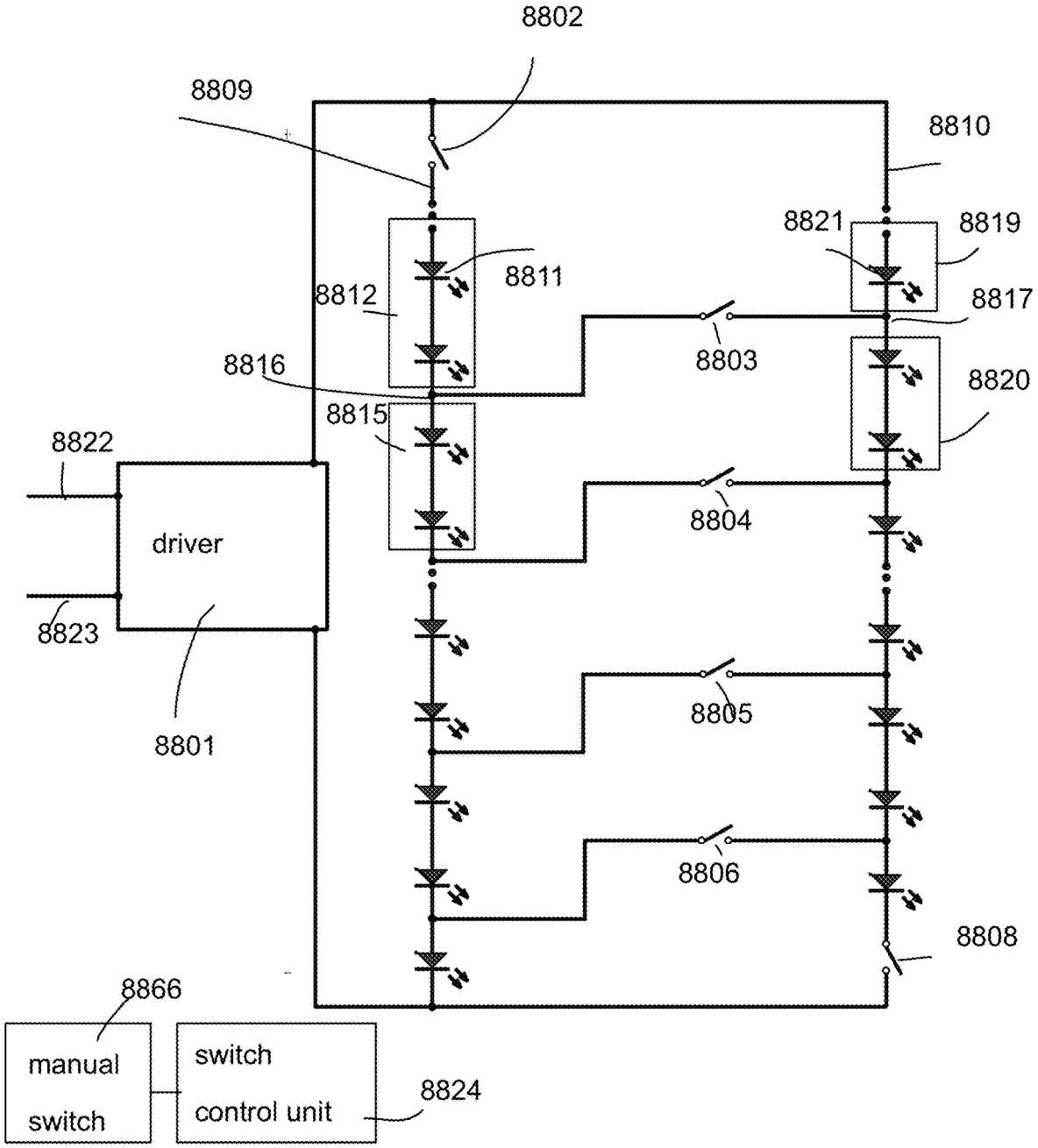
FIG. 10 illustrates a structure view of an embodiment.

In FIG. 10, a lighting apparatus includes a driver, a first branch 8809, a second branch 8810, a first switch 8802, a second switch 8808, multiple middle switches 8803, 8804, 8805, 8806, and a switch control unit 8824.

In some other embodiments, there may be more than two branches of LED modules. There are various ways for implementing the switch control unit 8824 and some examples are explained in following disclosure. The first switch 8802, the second switch 8808, the multiple middle switches 8803, 8804, 8805, 8806 are controlled to be turned on or turned off by and connected to the switch control unit 8824.

The driver 8801 converts an indoor power source to a driving current. For example, a neural line 8822 and a live line 8823 are guided to an indoor power source of 110V/220V alternating current is converted by the driver 8801 to a direct current driving current for driving LED modules to emit light.

The first branch 8802 includes multiple first LED modules 8811. The multiple first LED modules 8811 are divided into multiple first segments 8812, 8815. There are first nodes 8816 between adjacent first segments 8812, 8815. Each first segment 8812, 8815 may include one or multiple first LED modules 8811. Each first LED module 8811 emits a light with a first optical parameter when receiving a proper driving current.

The second branch 8810 includes multiple second LED modules 8821. The multiple second LED modules 8821 are divided into multiple second segments 8819, 8820. There are second nodes 8817 between adjacent second segments 8819, 8820. Each second segment 8819, 8820 may include one or multiple second LED modules 821. Each second LED module 8821 emits a light with a second optical parameter when receiving a proper driving current. The first optical parameter may correspond to a first color temperature and the second optical parameter may correspond to a second color temperature.

The first switch 8802 is selectively connecting the driving current into the first branch 8809. The second switch 8808 is selectively connecting the driving current into the second branch 8810. The multiple middle switches 8803, 8804, 8805, 8806 are selectively connecting the first nodes 8816 and second nodes 8817. Specifically, all LED modules in the lighting apparatus are divided into the first segments 8812, 8815 on the first branch 8809 and the second segments 8819, 8820 on the second branch 8810. By selecting the first switch 8802, the second switch 8808 and the middle switches 8803, 8804, 8805, 8806, the conductive path is selected and the LED modules on the selected conductive path is supplied with the driving current. The LED modules not on the selected conductive path is turned off. When the LED modules have different types, selections of different types of LED module correspond to different optical parameters.

The switch control unit 8824 is used for controlling selections of the first switch, the second switch and the multiple middle switches 8803, 8804, 8805, 8806 for determining a conductive path of a selected set of LED modules selected from the multiple first segments and the multiple second segments for mixing a required optical parameter.

In some embodiments, the first LED modules refer to a first type of LED module emitting a light of a first color temperature. The second LED module refer to a second type of LED module emitting another light of a second color temperature. The parameter color temperature may be replaced as color or any other optical parameter.

In some embodiments, the first LED modules emit a first light with a first color temperature, and the second LED modules emit a second light with a second color temperature.

In some embodiments, the first segments have multiple types of mixed optical parameters.

Specifically, not every first segment has the same kinds of LED modules. More than one types of LED modules may be placed in the same first segment, making each first segment having different features. In some other embodiments, the first segments may have multiple types of optical parameters. In some other embodiments, the first segments may all have the same type of optical parameter.

Similarly, the second segment may have the same configuration as the first segments as mentioned above.

Specifically, there are multiple first segments. These first segments may have both a first type of LED module and a second type of LED module. The number ratio of the first type of LED module and the second type of LED module may not be the same in every first segment. In other words, there may be multiple types of first segments containing different number ratio of the first type of LED module and the second type of LED module. The first type of LED module and the second type of LED module indicates that different types of LED module may have different optical parameters like color temperatures.

In some embodiments, at least two first segments have different number ratio of a first type of LED module and a second type of LED module.

In some embodiments, the driver includes a linear driver circuit for generating a constant current as the driving current.

What challenges the most in design of an off-line LED driver is that the forward voltage of an LED is relatively constant, while the power voltage from the power grid is in sine wave. For this reason, most solutions are subject only to the switch-type conversion architecture with the function of changing the voltage. The linear drive is essentially to connect variable resistors and LEDs in series to share the input voltage. Simple use of the linear architecture may cause mismatching between the input and output voltages. When the input voltage is lower than the forward voltage of an LED, no current passes through the LED. Otherwise, a resistor or an equivalent device must be added to undertake the excessive voltage, from which the energy is completely wasted. This may give rise to current deformity, posing a threat to normal operation of the power grid.

To take advantage of such a simple linear circuit, and maximize matching with the supply waveform in the power grid, the best method is to divide an LED into segments as many as possible, and timely combine different numbers of LED segments by different input voltage conditions for matching to minimize the voltage loss. In terms of current, different currents need to pass through the LED at different voltages to achieve a high power factor. Theoretically, we can obtain the nearly 100% conversion efficiency and the power factor approaching 1 in the case of infinite LED voltage and current segments. However, we can only make a compromise between performance and cost to achieve feasibility. As a result, linear driver circuits come out.

One is the so-called constant-current diode, which is a two-pin element being capable of one-way breakover, but the passing current is almost stable. When thinking that the element is expensive, you can easily replace it with a simple constant-current circuit consisting of two resistors, one voltage regulator diode, and one common transistor. The constant-current diode can be directly connected to the LED in series and then placed in the circuit for use. However, large current and high voltage applied on such a diode may cause severe power dissipation and low efficiency. Therefore, the high-voltage and low-current LED series should be used to lower the dissipation and improve the efficiency. However, the downside is that stable current can pass through the LED only when the input voltage is higher than the LED forward voltage and the minimum voltage drop of the constant-current diode. No current is output in other situations. Moreover, higher efficiency may result in longer time in which no current passes through the LED as well as a lower power factor.

The other one is the improved and segment-based pass-through LED drive. With such a drive, the LED is divided into several segments and connected in series. Then the connecting points between segments are connected to the constant-current source via a switch. When the input voltage is applied, the power volume of the LED shall be adjusted in real time based on the voltage for the maximal utilization ratio of the LED and full use of the electric energy.

In FIG. 10, the switch control unit 8824 is configured with a manual switch 8866 operated by a user.

In some embodiments, the manual switch provides multiple options, each option corresponding to one conductive path of corresponding selected set of LED modules selected from the multiple first segments and the multiple second segments for mixing a required optical parameter In some embodiments, the switch control unit and the driver are integrated as an integrated chip, the first segments and the second segments are connected to the integrated chip for performing the first switch, the second switch and the multiple middle switches.

In some embodiments, the first LED modules and the second LED modules are high voltage LED devices.

In some embodiments, the switch control unit is a direct switch toggling circuits, not made as a micro control unit (MCU), which adds significant cost and increases complexity of the circuit design.

In some embodiments, a manual switch has multiple options to be selected by a user, each option is translated to turn on a switch set from the first switch, the second switch and the multiple middle switches.

In some embodiments, a manual switch has multiple options to be selected by a user, each option corresponds to turn on one corresponding middle switch.

Figure 11:
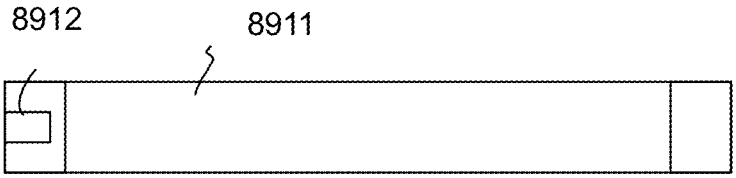
FIG. 11 shows a light tube example.

In FIG. 11, the lighting apparatus may also include a tubular housing 8911 for disposing the first branch and the second branch, wherein a manual switch 8912 has multiple options to be selected by a user, the manual switch 8912 is placed on an end cap of tubular housing.

As the example of FIG. 8, the lighting apparatus may also include a bulb shell for disposing the first branch and the second branch, wherein a manual switch has multiple options to be selected by a user, the manual switch is placed on a bulb head connected to the bulb shell.

Figure 12:
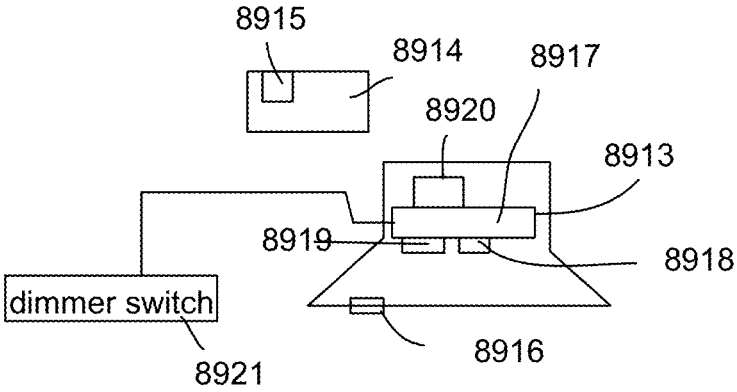
FIG. 12 shows a downlight example.

In FIG. 12, the lighting apparatus may also include a downlight housing 8913 for disposing the first branch and the second branch, wherein a manual switch 8914 has multiple options to be selected by a user. The manual switch 8915 is placed on a driver box 8914 connected to the downlight housing.

In FIG. 12, the lighting apparatus may also include a downlight housing with a light source plate 8917 for disposing the first branch and the second branch, wherein a manual switch 8916 has multiple options to be selected by a user. The manual switch 8916 is placed on a surface rim of the downlight housing. The driver 8919 and the switch control unit 8918 are disposed on the light source plate 8917.

In FIG. 12, the lighting apparatus may also include a wireless module 8920 for receiving an external command from an external device. The wireless module 8920 is connected to the switch control unit. The switch control unit determines using the external command or a manual switch based on a predetermined priority list.

In some embodiments, the driver is connected to a dimmer switch 8921. The dimmer switch 8921 provides a setting for the driver to adjust the driving current.

In some embodiments, the setting of the dimmer switch is divided into a set of dimmer options, each dimmer option corresponds to control the switch unit to select a selected from the first segments and the second segments.

In some embodiments, the first segments and the second segments have multiple light intensity levels, and an output light intensity is determined by selecting a selected set from the first segments and the second segments.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a driver for converting an indoor power source to a driving current;

a first branch, comprising multiple first LED modules connected in series, one or more of the multiple first LED modules being divided into one or more of a multiple first segments, each adjacent first segments being connected with a respective first nodes;

a second branch, comprising multiple second LED modules connected in series, one or more of the multiple second LED modules being divided into one or more of a multiple second segments, each adjacent segments being connected with a respective second nodes;

a first switch selectively connecting the driving current into the first branch;

a second switch selectively connecting the driving current into the second branch;

multiple middle switches selectively connecting the first nodes and second nodes, wherein each first node and second node is connected with only one middle switch;

a switch control unit, for controlling selections of the first switch, the second switch and the multiple middle switches for determining a conductive path of a selected set of LED modules selected from the multiple first segments and the multiple second segments for mixing a required optical parameter, wherein the switch control unit is configured with a manual switch operated by a user, wherein the manual switch provides multiple options, each option corresponding to one conductive path of corresponding selected set of LED modules selected from the multiple first segments and the multiple second segments for mixing a required optical parameter.

2. The lighting apparatus of claim 1, wherein the first LED modules emit a first light with a first color temperature, and the second LED modules emit a second light with a second color temperature.

3. The lighting apparatus of claim 1, wherein the first segments have multiple types of mixed optical parameters.

4. The lighting apparatus of claim 3, wherein at least two first segments have different number ratio of a first type of LED module and a second type of LED module.

5. The lighting apparatus of claim 1, wherein the driver comprises a linear driver circuit for generating a constant current as the driving current.

6. The lighting apparatus of claim 1, wherein the switch control unit and the driver are integrated as an integrated chip, the first segments and the second segments are connected to the integrated chip for performing the first switch, the second switch and the multiple middle switches.

7. The lighting apparatus of claim 1, wherein the first LED modules and the second LED modules are high voltage LED devices.

8. The lighting apparatus of claim 1, wherein the switch control unit is a direct switch toggling circuits, not made as a micro control unit.

9. The lighting apparatus of claim 1, wherein a manual switch has multiple options to be selected by a user, each option is translated to turn on a switch set from the first switch, the second switch and the multiple middle switches.

10. The lighting apparatus of claim 1, wherein a manual switch has multiple options to be selected by a user, each option corresponds to turn on one corresponding middle switch.

11. The lighting apparatus of claim 1, further comprising a tubular housing for disposing the first branch and the second branch, wherein a manual switch has multiple options to be selected by a user, the manual switch is placed on an end cap of tubular housing.

12. The lighting apparatus of claim 1, further comprising a bulb shell for disposing the first branch and the second branch, wherein a manual switch has multiple options to be selected by a user, the manual switch is placed on a bulb head connected to the bulb shell.

13. The lighting apparatus of claim 1, further comprising a downlight housing for disposing the first branch and the second branch, wherein a manual switch has multiple options to be selected by a user, the manual switch is placed on a driver box connected to the downlight housing.

14. The lighting apparatus of claim 1, further comprising a downlight housing with a light source plate for disposing the first branch and the second branch, wherein a manual switch has multiple options to be selected by a user, the manual switch is placed on a surface rim of the downlight housing, the driver and the switch control unit are disposed on the light source plate.

15. The lighting apparatus of claim 1, further comprising a wireless module for receiving an external command from an external device, the wireless module is connected to the switch control unit, the switch control unit determines using the external command or a manual switch based on a predetermined priority list.

16. The lighting apparatus of claim 1, wherein the driver is connected to a dimmer switch, the dimmer switch provides a setting for the driver to adjust the driving current.

17. The lighting apparatus of claim 16, wherein the setting of the dimmer switch is divided into a set of dimmer options, each dimmer option correspond to control the switch unit to select a selected from the first segments and the second segments.

18. The lighting apparatus of claim 1, wherein the first segments and the second segments have multiple light intensity levels, and an output light intensity is determined by selecting a selected set from the first segments and the second segments.

* * * * *